US005398838A

United States Patent [19]

Dosunmu

[11] Patent Number: 5,398,838

[45] Date of Patent: Mar. 21, 1995

[54] RAD RECYCLE BIN

[76] Inventor: Razak A. Dosunmu, 3239 Chestnut St., NW., Washington, D.C. 20015

[21] Appl. No.: 939,159

[22] Filed: Oct. 7, 1992

[51] Int. Cl.[6] ..... B65D 25/16

[52] U.S. Cl. ..... 220/404; 220/524; 220/552; 220/532; 220/533; 220/709

[58] Field of Search ..... 220/404, 524, 552, 555, 220/557, 909, 532, 533

[56] References Cited

U.S. PATENT DOCUMENTS

| | | | |
|---|---|---|---|
| 4,834,262 | 5/1989 | Reed | 220/404 |
| 4,874,111 | 10/1989 | Heller | 220/404 |
| 4,893,722 | 1/1990 | Jones | 220/23.83 |
| 4,974,746 | 12/1990 | Dickinson | 220/404 |
| 4,988,010 | 1/1991 | Pollak | 220/503 |
| 5,046,635 | 9/1991 | Haas et al. | 220/524 |
| 5,174,468 | 12/1992 | Holderman | 220/571 |

FOREIGN PATENT DOCUMENTS

| | | | |
|---|---|---|---|
| 3531554 | 3/1987 | Germany | 220/909 |

OTHER PUBLICATIONS

United States Copyright, VA 536-802, Nov. 4, 1992, RAD Bin No. 4.

United States Copyright, VA 536-801, Nov. 4, 1992, RAD Recycle Cart.

United States Copyright, VA 536-803, Mar. 16, 1992, RAD Practical Recycle Cart.

*Primary Examiner*—Allan N. Shoap
*Assistant Examiner*—Stephen Cronin

[57] ABSTRACT

A five compartment bin and accessories for use in separation of solid waste into recyclable and trash or to hold classified items of objects separately. The bin is divided into four top bin and a bottom compartment.

4 Claims, 4 Drawing Sheets

RAD RECYCLE BIN

TITLE OF THE INVENTION

A five compartment bin for the separation of recyclable materials and Trash.

BACKGROUND OF THE INVENTION

This invention is for use in solid waste reduction by separation of recyclable materials and trash. The prior art on the invention is documented in U.S. patent Document Des 322703 Dosunmu. A four compartment bin with a bottom drawer, covered with a hooded lid with four access doors, to the top four compartment, equipped with a clean out hole to a bottom drawer compartment.

This bin is now improved with a flat top lid, with four access doors hinged to the lid. The flat top lid is equipped with a placement dowel, to ensure that the lid can only be placed in one possible position on to the master bin, to ensure deposit of recyclable materials and trash as labelled or classified for recycling requirement. This measure will prevent accidental mix up of recyclable materials and trash. The flat top lid in this application is to replace the hooded lid, shown in U.S. patent document Des 322703. The flat top lid is convenience during storage for effective use of limited retail or warehouse space. The five compartment bin is a master bin with groves molded on to each inside four walls, to insert a removable separator that forms the top four compartment and a bottom cavity with a rail to slide in a drawer that makes the fifth compartment. When the divider is removed it allows stacking of the bin in storage for efficient utility of limited storage space in transporting of bin, at warehouse and retail stores. The flat top lid has lift up access doors for use in depositing of recyclable materials and trash. This flat top lid gives users easier access to the bin from one standing location, unlike the hooded lid that requires some movement around the bin to make deposits into separate compartments which are classified for recycling. The access doors are hinged to the lid. The four top lid may be labelled for use to hold Trash, Aluminum, Glass, Plastic and the bottom bin drawer for paper or paper products such as juice or milk cartons which may be flattened and stored in the bottom drawer.

SUMMARY OF THE INVENTION

The five compartment bin comprises a master bin divided into four upper bins and a bottom drawer. The upper bins are equipped with four clips to hold flexible liners in place. The master bin is covered with a flat top lid with four access doors to the top four compartments. The access doors are hinged to the lid or may be formed with pressure sensitive material with a partition that allows deposit and return to place after deposit is made. The access doors are labelled with classifications to aid users in depositing per the recyclable materials or trash classification shown on the access doors to the bins. The lid has a main lift up handle. The lid's four access doors are each fitted with lift up handles.

Labels in lettering or pictorial form may be affixed on the lid's access doors to the bins and on the front of the drawer. The access doors to the upper bins may be labelled respectively: Aluminum, Plastic, Glass, Trash and the bottom drawer labeled Paper. A second, alternative labelling for each compartment is; Plastic, Paper, Biohazard, Glass, Aluminum for use in hospitals. A third alternative would be Plastic, Paper, Aluminum, Biodegradable, Glass.

The accessories that work best with the five compartment bins are, labelled bags, labelled to show what the bags hold or contain in each compartment. The bags are clipped into the inside of each of the upper bins with four clips in each compartment. The bags will be color coded to identify the contents of the bags held in the bin when removed from the bin. For example bags to contain aluminum will be labelled Aluminum and color coded slate blue. Bags to hold plastics are labelled Plastic and color coded white. Bags to hold glass are labelled Glass and color coded clear. Bags to hold paper are labelled Paper and color coded green. The bags can be made with any material but preferably plastic or paper. The five compartment bin is used in a logistic system of holding, and moving recyclable and trash separately for solid waste separation of recyclable materials and trash. The system is designed to aid solid waste reduction and to enhance retrieval of reusable items from solid waste generated by the household, and in public space maintenance. The use of this bin in household, public space maintenance, office, hotels and restaurants, will enhance our National environmental restoration by eliminating the need for use of landfill and incinerators. The use of the bin will alleviate the demand on labor and mechanical energy intensive sorting centers, since recyclable materials and trash will be pre-sorted. The labelled recycling bags used to hold the recyclable materials and trash while in transit to the material recovery center will enhance the effort of the center's identification of the recyclable materials and trash. This system has an advantage over current curbside collection. In the current system where all recyclable materials and trash are collected together and then re-sorted at material recovery centers, the recyclable materials are impregnated with debris and contaminated. The bin can be fabricated, most economically in plastic.

DETAILED DESCRIPTION OF THE PRIOR ART

Figure 1:
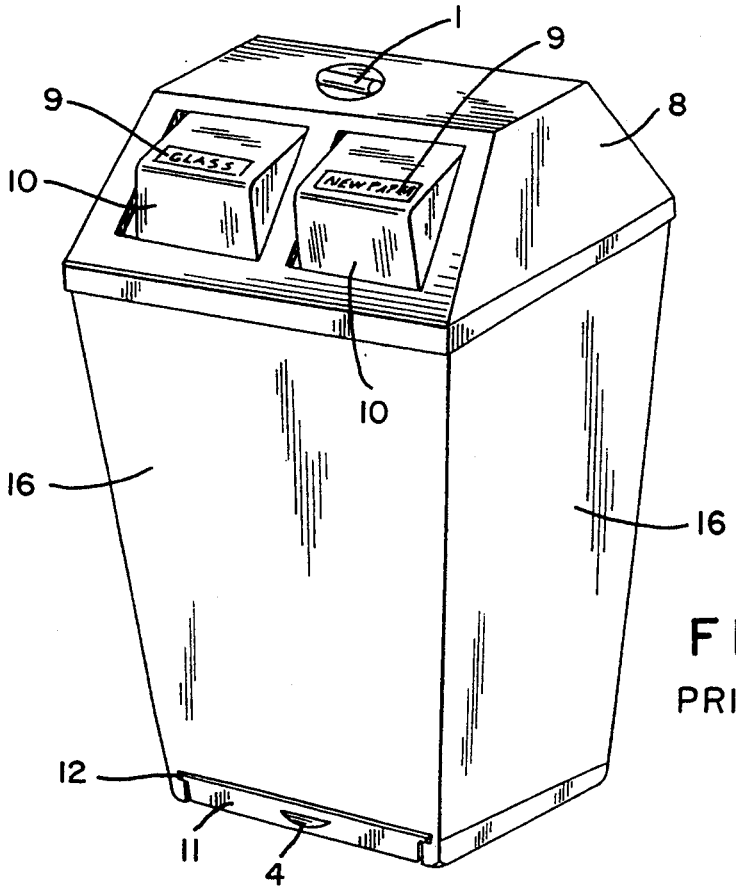
FIG. 1 PRIOR ART
FIG. 1 is a perspective of the prior art of my invention
Figure 2:
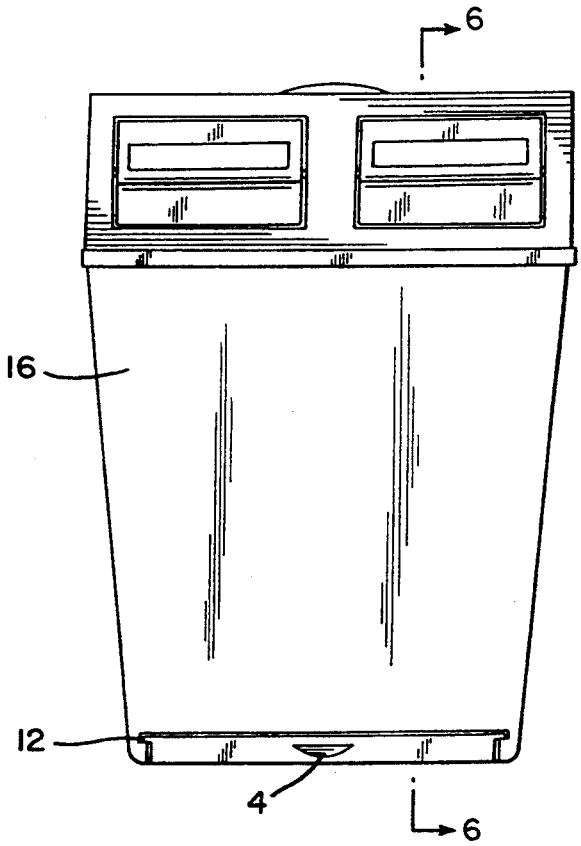
FIG. 2 PRIOR ART
FIG. 2 is the front view of the prior art

FIG. 1 is a perspective of the prior art of my invention U.S. Patent Document Des 322703, showing the bin with a hooded lid (8) and two Access doors hinged to the lid (10). The access doors have a label or tag (9)

showing items for deposit separately into the four top compartment. The hood may be lifted up with a handle as shown with reference to number (7). The hood when closed rests on the main body of the master bin (16). The bottom drawer slids into place (11) or tracks 12. A handle is used to pull the bottom drawer open(4). FIG. 2 is the front view.

Figure 3:
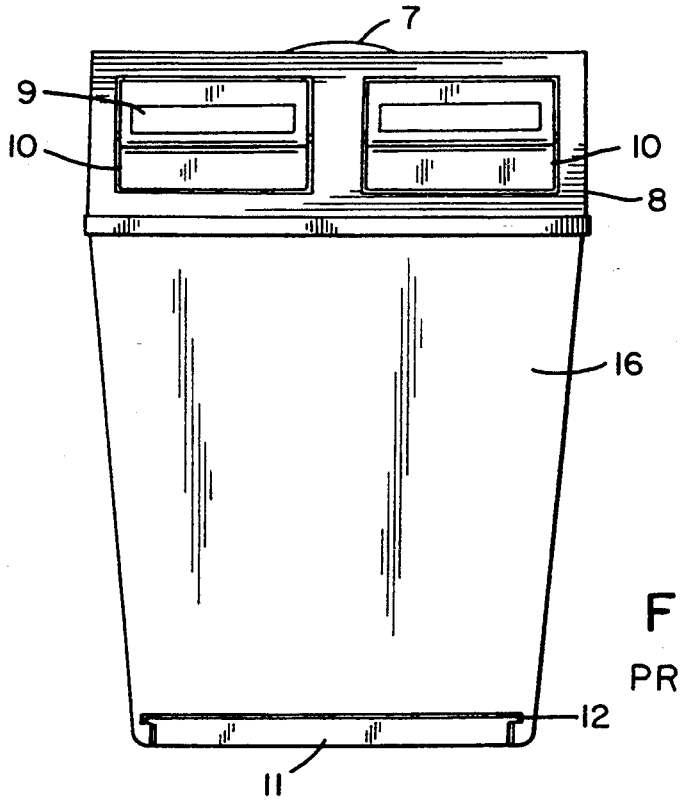
FIG. 3 PRIOR ART
FIG. 3 is the rear view of the prior art
Figure 4:
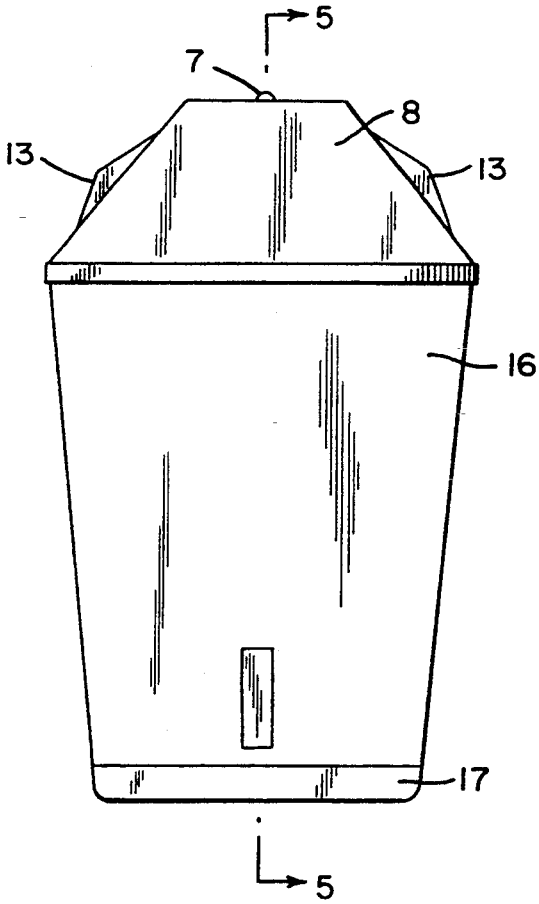
FIG. 4 PRIOR ART
FIG. 4 is the side view of the prior art

The master bin is molded with a grove on the bottom allowing a rail on the bottom drawer to slid into place.(12) FIG. 3 is the rear view of the master bin (16) showing the lid, at rest on the master bin, with the access doors to the compartment (10) and a space for a label or tag. (9). This view shows the bottom drawer, with the grove (12) and a lift up handle for the lid (7). FIG. 4 is a side view showing the side of the access doors to the compartment (13). This figure further shows the side view of the hood (8), the lift up handle on the lid (7), and the main body of the master bin (16).

Figure 5:
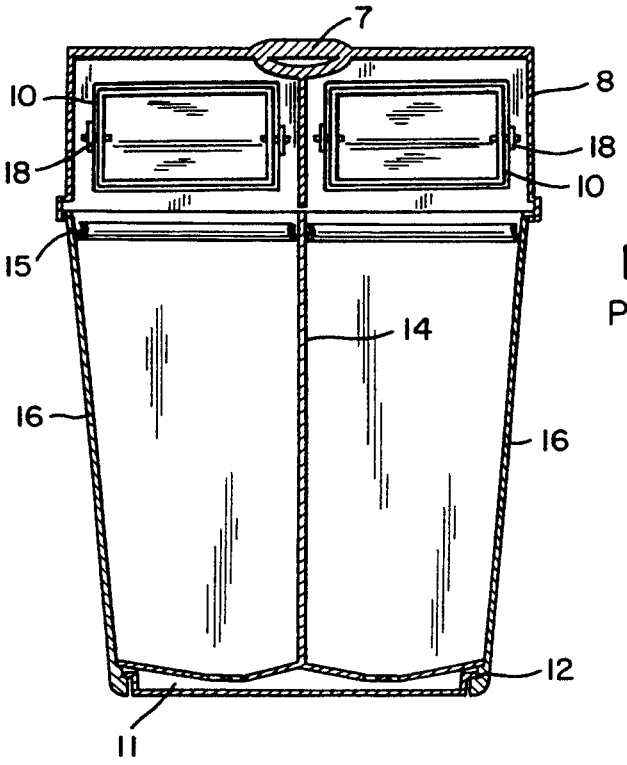
FIG. 5 PRIOR ART
FIG. 5 is a section of FIG. 2 line 5—5 of the prior art

FIG. 5 is a section of FIG. 2 line 5—5. This section shows the master bin (16), the divider that separates the master bin into the four top compartments (14), the lift up handle's section view (7), the lid (8), access doors (10) hinged to the lid (18) to allow the doors to swing inwardly clockwise to allow items for deposit into the compartment, a section view of the bottom drawer (11) and the groves for the drawer to slid in place (12). This section view shows clips (15) to hold bags in place in the compartments.

Figure 6:
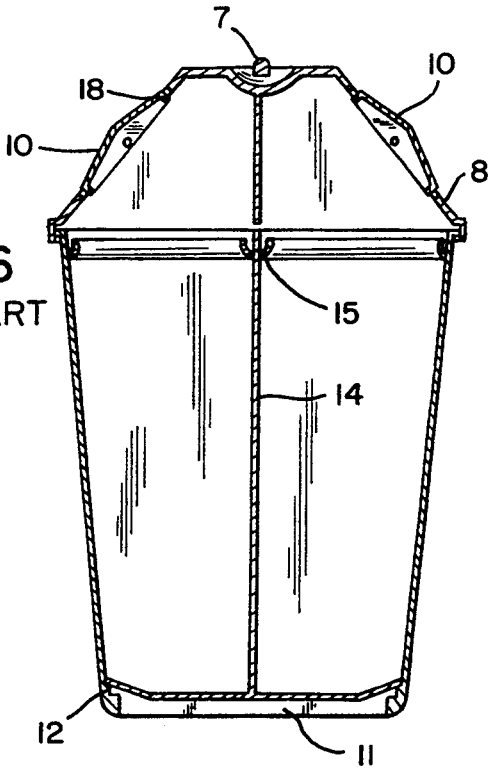
FIG. 6 PRIOR ART
FIG. 6 is a section of FIG. 4 line 6—6 of the prior art

FIG. 6 is a section of FIG. 4 showing the lid (8), the access door (10), the lift up handle (7), the divider or separator (14), clips for bags (15) and the cavity space for the bottom drawer to slide in place (17) an alternate hinge position for a clockwise turn of the access doors to allow deposit into the compartments.

Figure 7:
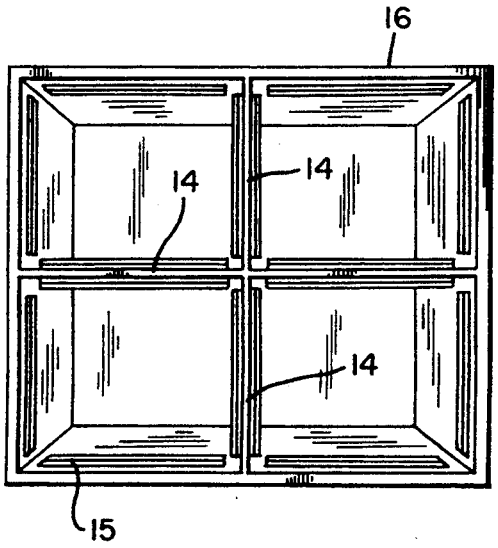
FIG. 7 PRIOR ART
FIG. 7 is a top view without lid of the prior art

FIG. 7 is a top view without the lid showing the master bin (16) the dividers (14) and clips to hold bags in place (15).

DETAILED DESCRIPTION OF THE PREFERRED EMBODIMENTS

Figure 8:
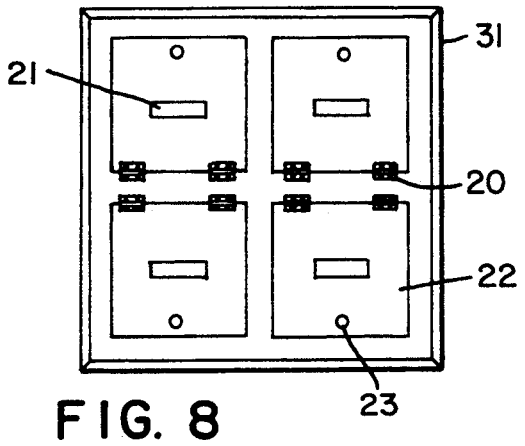
FIG. 8 is the top view of the preferred embodiment of my invention
Figure 9:
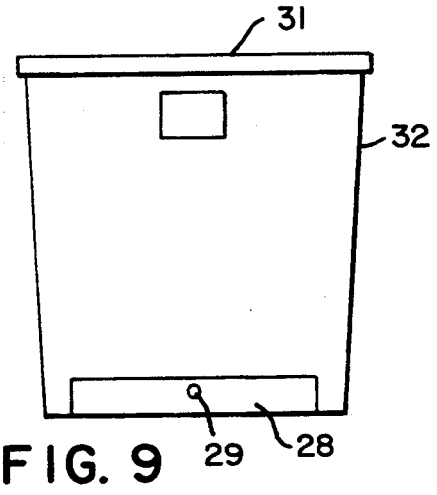
FIG. 9 is the front elevation with the preferred embodiment
Figure 10:
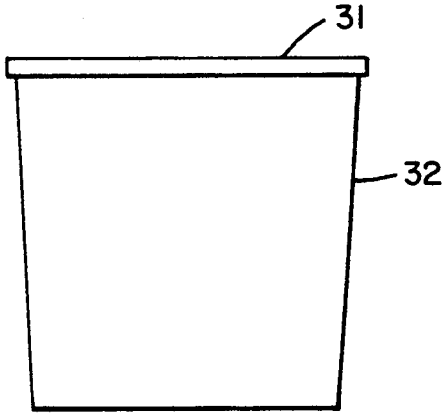
FIG. 10 is the side Elevation with the preferred embodiment
Figure 11:
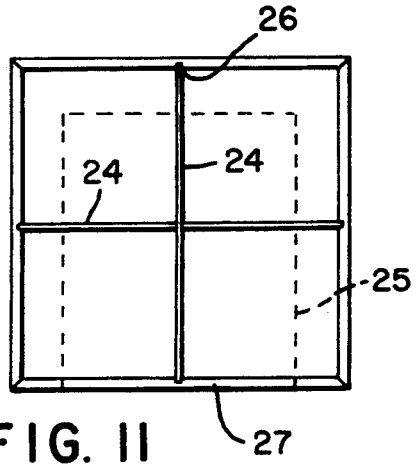
FIG. 11 is a section view of the bottom, compartment
Figure 12:
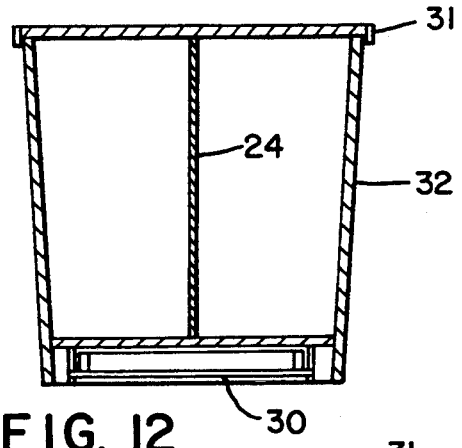
FIG. 12 is a front section view
Figure 13:
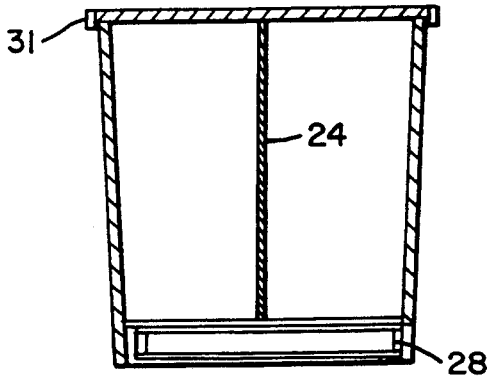
FIG. 13 is the side section of the master bin with preferred embodiment
Figure 14:
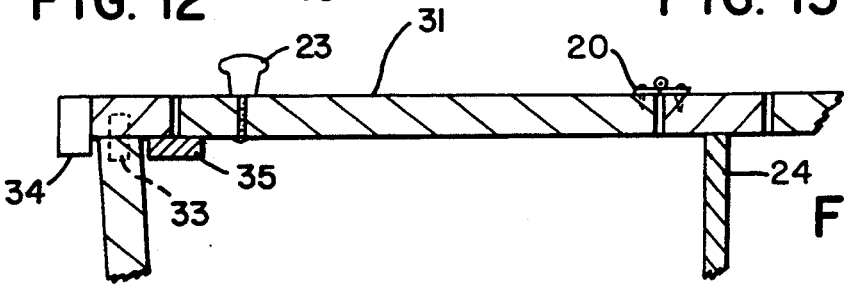
FIG. 14 is a detail of a door top, The preferred embodiment

FIG. 8 is a top view of the preferred improved lid and container. A flat top lid (31) has four access doors (22) hinged to its main body. The top view shows two hinges (20) holding each door to the lid. A total of eight hinges are required for the four access doors. Each door is equipped with a door stopper (35) as shown on FIG. 14. Each access doors has space for a label (21). FIG. 9, is a front elevation of the preferred lid and container showing the pull out paper tray or drawer (28) the paper tray or drawer has a knob (29) for pulling out the tray. FIG. 9 shows the flat top lid (31) set on to the master bin (32). FIG. 10, is a side elevation showing the lid (31) set on the master bin 32. FIG. 11, is a section of the bottom showing grooves (26), where the removeable divider (24) slids into place and an outline of the drawer (25). This figure shows the dowel (27) on which the lid is positioned. FIG. 12, is a front section showing the tray bottom (30). FIG. 13, is a side section of the bin showing the pull out tray or drawer, (28) and the lid (31) set on the master bin (32). FIG. 14, is a detail structure of the lid (31) with an access door (22) and the access door lift up Knob (23). The access door sets on a door stopper (35) which holds each door in position. A downward extending flange (34) depends from the top of the lid. The detail further shows the positioning dowel (27).

I claim:

1. A compartmented bin for the separation of recyclable materials and trash, said bin comprising:

a master bin having a front wall, a rear wall, two side walls and a bottom wall; said walls forming an upstanding rectangular container with an open top; each of said front, rear, side and bottom walls having an inner and an outer surface and said front, rear and side walls forming a rim at said open top; said side walls further extending downwardly from said bottom wall to form a bottom edge upon which said container rests and having a horizontally extending groove on the inner surface of said side walls adjacent the outer surface of said bottom wall to form a shallow open ended cavity; said inner surface of each of said front, rear and side walls further having a vertical groove extending from said rim to a point adjacent the inner surface of said bottom wall;

a pair of vertically extending rectangular dividers, said dividers intersecting each other at a right angle to form an intersecting partition, said partition slidably engageable with said vertical grooves to form four vertically extending compartments inside said bin;

a bottom drawer having a front wall, a rear wall, two side walls and a bottom wall; said drawer walls forming a shallow vertically extending tray with an open top; said drawer front wall further having a handle and said drawer side walls each having a horizontally extending rail; said horizontal rails of said tray slidably engaging said horizontal grooves of said cavity to form a shallow bottom compartment covered by the bottom of said bin for the storage and removal of flat recyclable materials;

a flat top lid having a planar, rectangular top wall with an upper and lower surface, a outer perimeter and four rectangular openings extending through said upper and lower surface; a downwardly extending flange attached to said perimeter and extending downwardly from said lower surface of said top wall; four planar rectangular access doors, each of said access doors hingably attached to said top wall and covering a respective one of said openings, each of said doors further having a handle to assist in the opening and closing of the doors; said flat top lid engaging the rim of said bin with said rectangular openings aligned with said compartments and said flange extending below said rim to form a removable top for said bin; said access doors allowing the deposit of recyclable materials and trash into the compartments without removing said lid and said lid being removable from said bin to allow the removal of said recyclable materials and trash.

2. The compartmented bin of claim 1, further comprising clips attached to the inner surface of said front wall, said rear wall, said side walls and said partition to provide a means for attachment of plastic bags in each of said vertically extending compartments.

3. The compartmented bin of claim 2, wherein each of said plastic bags is color coded and labeled to identify the type of recyclable materials and trash it is intended to contain.

4. The compartmented bin of claim 1, wherein each of said access doors is labeled to provide a means for identifying the type of recyclable materials and trash each compartment is intended to contain.

* * * * *